United States Patent [19]

Koutonen

[11] Patent Number: 4,548,105

[45] Date of Patent: Oct. 22, 1985

[54] METHOD AND ARRANGEMENT FOR OBSERVING A POSITION

[75] Inventor: Pauli Koutonen, Järvenpää , Finland

[73] Assignee: Oy Wartsila Ab, Helsinki, Finland

[21] Appl. No.: 580,669

[22] Filed: Feb. 16, 1984

[30] Foreign Application Priority Data

Mar. 1, 1983 [FI] Finland ..... 830673

[51] Int. Cl.[4] ..... B26D 1/24

[52] U.S. Cl. ..... 83/13; 83/74; 83/498; 83/425.4; 83/522; 33/125 R

[58] Field of Search ..... 83/74, 13, 522, 498–499, 83/504, 508.2, 425.3, 425.4; 33/185, 125 R, 125 A

[56] References Cited

U.S. PATENT DOCUMENTS 3,540,340 11/1970 Koskela ..... 83/499
3,786,705 1/1974 Dorfel ..... 83/522
4,091,541 5/1978 Di Liaccio ..... 33/125 R
4,188,846 2/1980 Jones et al. ..... 83/499
4,224,847 9/1980 Tokuno ..... 83/71

*Primary Examiner*—James M. Meister
*Assistant Examiner*—John L. Knoble
*Attorney, Agent, or Firm*—John Smith-Hill

[57] ABSTRACT

In a method for determining, by means of an observing and recording measuring device the exact position of a movable member and/or for determining a corrective movement to be performed from a position of the member, a measuring device having a datum position is used. The method includes the steps of determining the position of the movable member and/or a required corrective movement thereof by moving the measuring device past the position of the movable member and determining a new position obtained through the corrective movement or, alternatively, re-determining the first mentioned position of the movable member by moving the measuring device a second time past the movable member in an opposite direction.

12 Claims, 3 Drawing Figures

Figure 3:
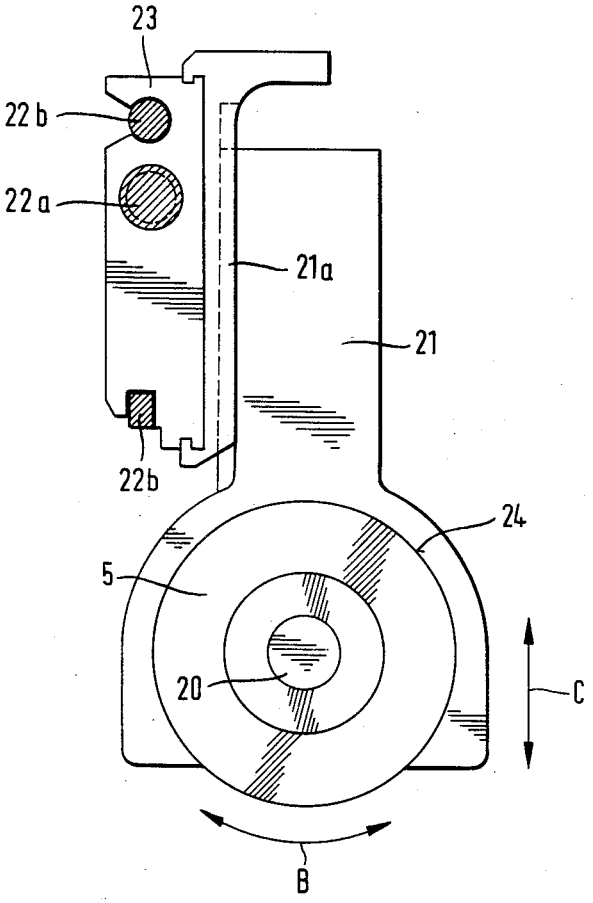

Fig. 1
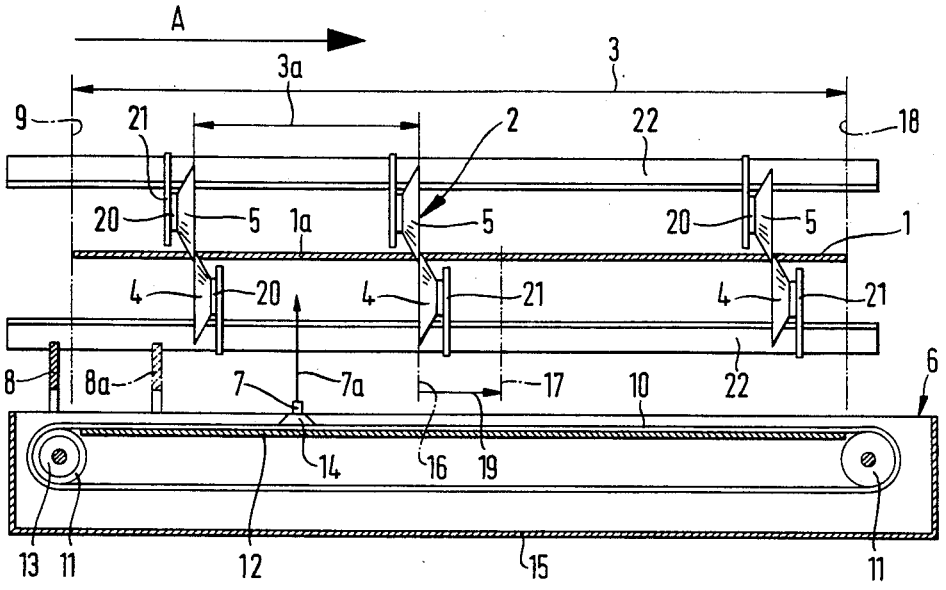
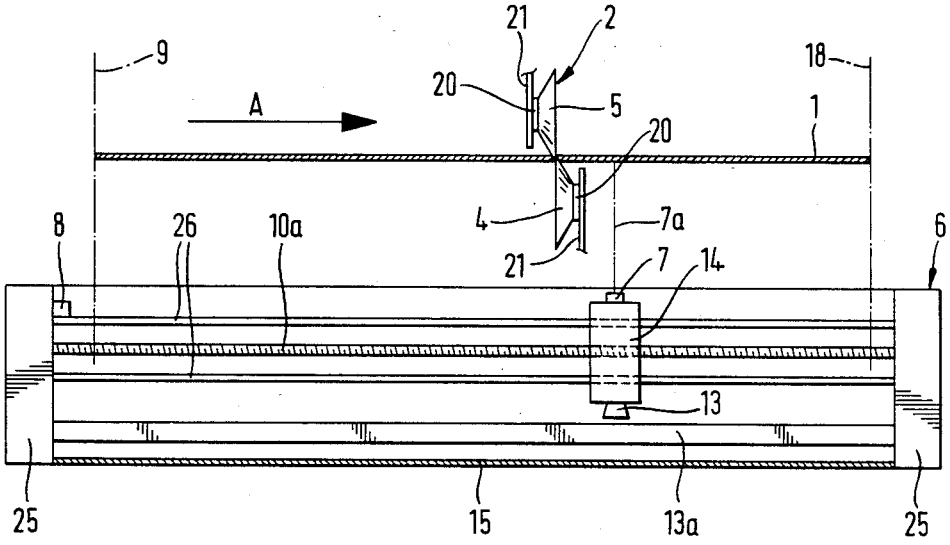
Fig. 2

METHOD AND ARRANGEMENT FOR OBSERVING A POSITION

The invention relates to a method for determining, by means of an observing and recording measuring device, the exact position of a movable member and/or for determining a corrective movement to be performed from a position of said member. The invention also relates to a system applying the method, for example a paper web slitting system, where the position of a slitting device and/or its corrective movement is arranged to be determined by means of a movable observing and recording measuring device.

In a machine for slitting a running web longitudinally, there are, in the cross-machine direction, a number of slitters cutting the web into several parallel web sections. The location of the slitters determines the width of the cut web sections. The slitters must be very accurately positioned in the cross-machine direction to obtain the desired cutting width. When replacing a worn slitter by a new one, the latter must again be positioned very exactly. The exact positioning of a slitter in a desired position has been a problem in the known art, because there has been a considerable risk of incorrect positioning. It is known to use a system in which the exact positioning of a slitter is made by starting each positioning movement from a datum position. Hence, when changing the slitter position, the slitter is first moved to the datum position. From the datum position, the slitter is moved a certain distance determined on the basis of the desired cutting position. However, after this movement, the actual position of the slitter is not checked. The system has several drawbacks. The moving of the slitter to the datum position and therefrom to the desired position is time consuming. The datum position itself may cause a measuring error, if it is not properly arranged. The movement to the desired position may include a transfer error, which is not observed until an incorrect cutting width is a fact, or alternatively, an extra control measurement must be made. Further, the wear of the slitters may cause measuring and positioning errors, if the wear changes the point of slitting relative to the position measuring point.

An object of the inventon is to create a method and a system, by means of which the actual position of a movable member, for example the positions of a number of slitter devices in paper web slitter-winder, can be measured directly without having to move the member to a datum position. Another object of the invention is to minimize the time used for position measurements.

Using the invention, the position of the movable member can be measured by moving a measuring device to an observation position, whereby the position reading of the measuring device corresponds to its distance from a datum position. By moving the measuring device first in one and then in the opposite direction for carrying out measuring observations, the position of the movable member is checked or a new position is determined, if the position of the movable member has been corrected after the first measurement.

By measuring the position of the slitting edge of a slitting device, the exact slitting position can always be accurately determined irrespective of any changes in the other parts of the slitting device. The slitting position is preferably measured by observing the position of the slitting edge of the lower one of a pair of slitter members. The movement of the observing device can be provided by an actuator.

In a preferred embodiment of the invention, a measuring device functioning without mechanical contact, for example an optic device, is used. Position registering means may be carried by the same support element and be moved by the same actuator as the measuring device. The actuator may be a screw mechanism or the like.

In another embodiment of the invention, the actuator is an endless conveyor belt with guides and pulleys. The movement of the belt is monitored by a position transducer and an observing transducer is attached to the belt and follows its movement. The observing transducer may be a contact sensor arranged to contact a reference surface in the datum position of the system and the slitting edge of the slitter, for example, at the lowest point of the lower slitter.

The invention will now be described, by way of example, with reference to the accompanying dawings, in which FIG. 1 is a cross-sectional view of a slitter positioning device according to the invention, FIG. 2 is a similar cross-sectional view of another embodiment of the invention, FIG. 3 is a side view of a slitter supporting arrangement.

In the drawings, numeral 1 indicates a paper web, which in FIGS. 1 and 2 travels through a slitting station perpendicularly to the plane of the drawing. In the slitting station, there are slitter devices 2 each comprising a pair of rotating slitters, in which a lower slitter 4 is below the web and an upper slitter 5 is above the web. The slitters 4, 5 are movable in the transverse direction A of the web 1 along its entire width 3 corresponding to the two limits 9 and 18 of the measuring system. The slitters are supported on guides 22 by means of support arms 21 each carrying a rotating slitter mounted by means of a bearing 20. The slitters 4, 5 cut the web 1 longitudinally into several longitudinal sections 1*a*. The distance between two adjacent slitter devices 2 corresponds to the width 3*a* of the cut web section 1*a*.

Measuring the position of the slitters 4, 5 in the transverse direction of the web 1 is made with a measuring device including an observation transducer 7 observing the position of the slitters 4, 5 and a stop or reference member 8 limiting the movement range of the transducer 7 or determining its datum position 9. The observation transducer 7 may be a contact sensor or a non-contact transducer, such as an optic, acoustic or electromagnetic sensor. The position of the transducer 7 when it observes the slitters 4, 5 gives a determination of the position of the slitters with respect to the datum position 9, which may be fixed or adjustable. The reference member 8 determining the datum position 9 may have a transferred auxiliary position 8*a*.

In the embodiment of FIG. 1, the transducer 7 is moved in the transverse direction of the web 1 by means of an actuator 6 in the form of a conveyor. The conveyor includes an endless conveyor belt 10, belt pulleys 11 journalled in a frame 15 and a belt support 12. The observation transducer 7 is mounted on a transducer support 14 carried by the belt 10. A position transducer 13 is connected to one of the belt pulleys 11 for recording the location of the observation transducer 7. The belt support 12 keeps the transducer 7 on a correct vertical level and keeps its observation direction 7*a* perpendicular to the web 1. The conveyor 10, 11 may be driven by an electric motor (not shown). Cables transmitting the signals of the transducers 7 and 13 to a recording device are not shown either. Two alternative positions 16 and 17 of a slitter device 2 are shown. The first position 16 is a pre-measurement position and the second position 17 is a final position, obtained by means of a corrective movement 19 based on the measurements.

In FIG. 2, the web 1 and the slitters 4 and 5 are shown only schematically, since the associated details correspond to those shown in FIG. 1. An observation transducer 7 and a position transducer 13 are carried by a common transducer support 14 moving on guides 26 in the transverse direction of the web 1. This movement is obtained by means of a rotating screw 10*a* of an actuator 6. There are supports 25 for the screw 10*a* and its driving motor, for the guides 26 and for a position scale 13*a*. The observation transducer 7 is an optical, laser-based transmitter-receiver transmitting a beam pulse 7*a* and observing the slitting edge of the slitters 4, 5. The position transducer 13 and the position scale 13*a* cooperate electromagnetically. The position scale 13*a* may have a magnetization being position dependent in the direction A.

FIG. 3 shows the support arrangement of an upper slitter 5. The slitter 5 is mounted on a support arm 21 and is freely rotatable in the directions of the arrow B. Numeral 24 indicates the slitting edge. A member 21*a* connects the support arm 21 to a slide 23 movable on guides 22*b* by means of a transfer rod 22*a*. The slide 23 has a short extension in the axial direction of the guides 22*b*, preferably less than 20 cm. The slide 23 is provided with releasable clamping means locking it to the transfer rod 22*a* for obtaining slide movement. The slide 23 is provided with means for moving the support arm 21 vertically (arrow C). The transfer rod 22*a* may be an axially movable rod, a rotating screw or the like.

The measuring and positioning process according to the invention will now be described with reference to FIG. 1. The position of the slitters 4, 5 is observed by the observation transducer 7 when it moves past the slitting edge of the slitters 4, 5. A datum position 9 for the transducer 7 is recorded by means of the reference member 8 (or 8*a*) and the position transducer 13. In practice, determination of the datum position is made by bringing the transducer 7 into reading contact with the reference member 8. By using a microprocessor, the output of the position transducer 13 and of the observation transducer 7 can be recorded simultaneously. This arrangement can also be used, when the datum position 9 has been adjusted by moving the reference member to a new position 8*a*. The observation function of the transducer 7, 13 is then stopped or started when the transducer 7 passes the reference member position 8*a*. Instead of stopping the observation function of the transducers 7, 13, an arrangement for stopping the movement of the conveyor 10, 11 may also be used. In that case, the reference member 8 is, for example, a limit switch stopping and starting the conveyor 10, 11. The recorded datum position reading can be made to form the zero point of the recording, whereby the positions 16, 17 observed by the transducer 7 and the corresponding reading of the position transducer 13 are measuring values as such. After recording the datum position 9, the transducer 7 does not have to be brought back into this position. For simplicity, a situation will now be described, in which the positions of all slitter devices 2 are between the transducer 7 and the right measuring limit 18. The measurement is described for one slitter device only.

The transducer 7 is moved by the conveyor 10, 11 in the direction towards the right measuring limit 18. When it passes the slitter device 2, it observes the position 16 of the device by observing, for example, the edge of the lower slitter 4. Recording of the reading of the position transducer 13 is preferably obtained simultaneously by using the observation signal of the transducer 7 as a trigger.

The reading indicating the position 16 of the slitter device is compared to a value corresponding to the desired position. If the actual position 16 of the slitter device differs from the desired position, a corrective movement 19 into a new position 17 is made. The transducer 7 is then moved in the opposite direction towards the datum position 9, whereby the position 17 obtained by the corrective movement 19 is measured. If no corrective movement has been made, a checking in the form of a repeated measurement of the position 16 is obtained.

The slitter device movement is described with reference to FIG. 3. A single slitter 5 is moved in the axial direction of the guides 22*b* by the clamping the slide 23 to the axially moving transfer rod 22*a*. In this way, several slitters 5 can be moved simultaneously by an equal distance. The slitters 5 may also be moved different distances by controlling the connection between the slides 23 the transfer rod 22*a*. Both slitters 4, 5 of a slitter device 2 (FIG. 1) can be moved simultaneously by controlling their connection to the associated transfer rods and the rod movements in exactly the same manner. After a replacement of one slitter, the distance between the slitters 4, 5 may be adjusted by moving one slitter only.

The invention is not limited to the embodiments shown, but several modifications thereof are feasible within the scope of the attached claims.

I claim:

1. A method of precisely determining the position along a path of movement of a member that is movable along said path of movement relative to a datum position, comprising:

(a) moving a measuring device independently of the movable member in one direction parallel to said path of movement to a first observation position, corresponding to the position of the movable member;

(b) indicating the distance between the first observation position and said datum position;

(c) if the distance indicated in step (b) is not substantially equal to the desired distance beween the movable member and the datum position, shifting the movable member from its position corresponding to the first observation position to an altered position, the shift being by such a distance and in such direction that the distance between the altered position and the datum position is substantially equal to said desired distance, whereas if the distance indicated in step (b) is substantially equal to the desired distance, maintaining the movable member stationary;

(d) moving the measuring device in said one direction to a position beyond the first observation position and said movable member;

(e) moving the measuring device in the direction opposite to said one direction to an observation position corresponding to the position of the movable member after step (c); and (f) indicating the distance between the observation position of step (e) and said datum position.

2. Apparatus for determining the position along a path of movement of a member that is movable along said path of movement relative to a datum position, comprising a measuring device which is movable parallel to the path of movement of said movable member and independently of said movable member and which includes means for observing said movable member and defining an observation position when the movable member is observed by the observation means, means for moving the measuring device in first and second opposite directions parallel to the path of movement of the movable member, and means for indicating the distance of the measuring device from said datum position when the measuring device is in an observation position.

3. Apparatus according to claim 2, in which the means for moving the measuring device comprise a movable support member and the measuring device is connected to said support member.

4. Apparatus according to claim 2, wherein the observing means comprise a detection transducer, for detecting the movable member and defining the observation position, and the means for indicating the distance of the measuring device from said datum position comprise a position transducer.

5. Apparatus according to claim 4, in which the means for moving the measuring device comprise a movable support member and the position transducer is attached to said support member.

6. Apparatus according to claim 4, wherein the observation transducer is a non-contact transducer.

7. Apparatus according to claim 4, comprising a reference member defining the datum position and wherein the observation transducer is a contact transducer which is arranged to be brought into contact with the reference member and with said movable member.

8. Apparatus according to claim 5, wherein the means for moving the measuring device include a rotatable screw and the movable support member comprises nut means threadedly engaging the rotatable screw.

9. Apparatus according to claim 2, wherein the means for moving the measuring device comprise an endless conveyor belt, a belt support and conveyor pulleys, and the means for indicating the distance of the measuring device from the datum position comprise a position transducer associated with one of said pulleys for indicating the movement of the conveyor belt.

10. Equipment for longitudinal slitting of a moving paper web, comprising at least one slitting device that is movable along a path of movement transverse to the paper web, and apparatus for determining the position along said path relative to a datum position of a member that is part of the slitting device, said apparatus comprising a measuring device which is movable parallel to the path of movement of said movable member and independently of said movable member and which includes means for observing said movable member and defining an observation position when the movable member is observed by the observation means, means for moving the measuring device in first and second opposite directions parallel to the path of movement of the movable member, and means for indicating the distance of the measuring device from said datum position when the measuring device is in an observation position.

11. Equipment according to claim 10, wherein said movable member is a slitter of the slitter device, and the observation means is arranged to observe a slitting edge of the slitter.

12. Equipment according to claim 11, wherein the slitting device has an upper slitter and a lower slitter, and said movable member is the lower slitter.

* * * * *